US005216464A

United States Patent [19]

Kotani et al.

[11] Patent Number: 5,216,464

[45] Date of Patent: Jun. 1, 1993

[54] IMAGE FORMING APPARATUS HAVING REPLACEABLE ELEMENT WHICH IS REPLACED BASED ON FREQUENCY OF USE

[75] Inventors: Akio Kotani, Aichi; Yoshiaki Takano, Toyohashi; Nobuhiro Mishima, Toyokawa, all of Japan

[73] Assignee: Minolta Camera Kabushiki Kaisha, Osaka, Japan

[21] Appl. No.: 806,638

[22] Filed: Dec. 13, 1991

[30] Foreign Application Priority Data

Dec. 17, 1990 [JP] Japan ..... 2-411424

[51] Int. Cl.[5] ..... G03G 21/00

[52] U.S. Cl. ..... 355/208; 355/203; 355/204

[58] Field of Search ..... 355/200, 203-210, 355/211, 260; 222/DIG. 1

[56] References Cited

U.S. PATENT DOCUMENTS

| | | | |
|---|---|---|---|
| 4,496,237 | 1/1985 | Schron | 355/209 |
| 4,503,960 | 3/1985 | Koeleman et al. | 355/209 X |
| 4,511,243 | 4/1985 | Smith | 355/209 |
| 4,589,080 | 5/1986 | Abbott et al. | 364/552 |
| 4,751,484 | 6/1988 | Matsumoto et al. | 355/207 |
| 4,860,052 | 8/1989 | Ito et al. | 355/209 |
| 4,961,088 | 10/1990 | Gilliland et al. | 355/206 |
| 5,021,828 | 6/1991 | Yamaguchi et al. | 355/209 |
| 5,036,361 | 7/1991 | Filion et al. | 355/209 |
| 5,066,978 | 11/1991 | Watarai et al. | 355/206 |

*Primary Examiner*—A. T. Grimley
*Assistant Examiner*—William J. Royer
*Attorney, Agent, or Firm*—Willian Brinks Olds Hofer Gilson & Lione

[57] ABSTRACT

An image forming apparatus which includes a replaceable element which is replaced in predetermined amount of use and predicting apparatus for predicting the time when the predetermined amount of use of the element is to be reached. The predicting apparatus predicts the time based on amount of use of the element per unit time and remaining amount of use of the element.

10 Claims, 14 Drawing Sheets

IMAGE FORMING APPARATUS HAVING REPLACEABLE ELEMENT WHICH IS REPLACED BASED ON FREQUENCY OF USE

BACKGROUND OF THE INVENTION

1. Field of the Invention

The present invention relates to an image forming apparatus wherein replaceable parts are to be replaced in connection with the frequency of use.

2. Description of the Related Art

Image forming apparatus are already available which have a total counter for counting the total number of copies produced. These image forming apparatus include maintenance parts which become consumed or deteriorate with the frequency of use and need to be replaced. The count value of the total counter serves as an index for maintenance, such that a particular maintenance part is replaced, for example, upon the count value reaching 100,000. When to replace the maintenance part is predicted based on the experience of the serviceman and with reference to the count value of the total counter and to the data acquired by the serviceman and concerning the environment in which the apparatus is installed, frequency of use and characteristics peculiar to each apparatus.

However, when the time of replacement of the maintenance part is predicted based on the experience of the serviceman as stated above, there arises the problem that the prediction of the replacement time is liable to involve errors if the serviceman is not fully experienced or the data collected is insufficient.

SUMMARY OF THE INVENTION

The main object of the present invention is to provide an improved image forming apparatus which is free of the above problem.

Another object of the invention is to make it possible to accurately predict when to replace a maintenance part in accordance with the conditions under which the apparatus is used, such as the environment in which the apparatus is used, frequency of use and characteristics peculiar to the apparatus.

To fulfill the above objects, the present invention provides an image forming apparatus comprising a replaceable element for use in connection with formation of images, first measuring means for measuring the amount of use of the element since the start of use, first calculation means for calculating from the result of measurement by the first measuring means the remaining amount of use of the element before a predetermined amount of use of the element is reached for the replacement of the element, counter means for counting a specified period, second measuring means for measuring the amount of use of the element during the specified period, second calculation means for calculating the amount of use of the element per unit time based on the result of measurement by the second measuring means, and means for predicting the time when the predetermined amount of use of the element is to be reached based on the results of calculation of the first calculation means and the second calculation means.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
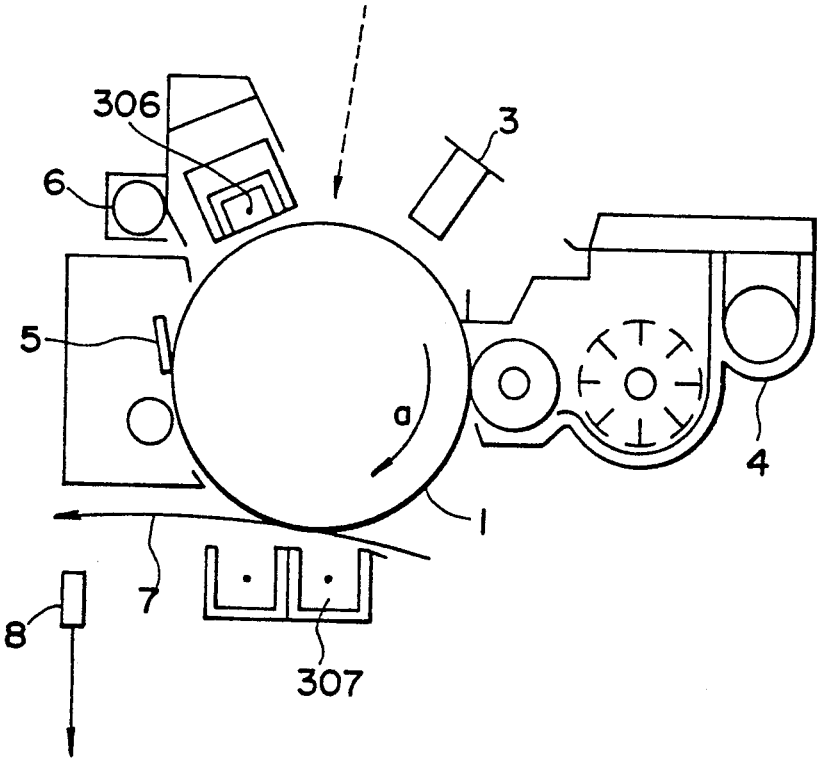
FIG. 1 is a sectional view schematically showing the construction of an image forming apparatus, i.e., a copying machine, embodying the invention.

FIG. 1 is a sectional view schematically showing the construction of an image forming apparatus, i.e., a copying machine, embodying the invention. Disposed approximately in the center of the diagram is a photosensitive drum 1 which is drivingly rotatable in the direction of arrow a. Provided around the drum 1 are sensitizing charger 306, suberaser 3, developing unit 4, transfer charger 307, cleaner 5 and main eraser 6 which are arranged in the order mentioned along the direction of rotation of the drum.

The photosensitive drum 1 is drivingly rotated in the direction a, uniformly charged by the sensitizing charger 306 and then exposed to light from a document exposure unit (not shown), whereby an electrostatic latent image is formed. Unnecessary portion of the latent image is erased with light from the suberaser 3. Subsequently, the latent image on the drum 1 is developed by the developing unit 4. The developed image is transferred by the transfer charger 307 to copy paper 7 given by a paper feeder (not shown). The paper 7 has the transferred imaged fixed thereto by a fixing unit (not shown) and is discharged as a copy. The drum 1 is further cleaned by the cleaner 5 and acted on by the main eraser 6 for the removal of residual charge. The discharge channel for the copy paper 7 is provided with a sensor 8 for detecting the passage of copies. The detection signal of the sensor 8 is given to the CPU 201 to be described below for detecting the number of copies.

Figure 2:
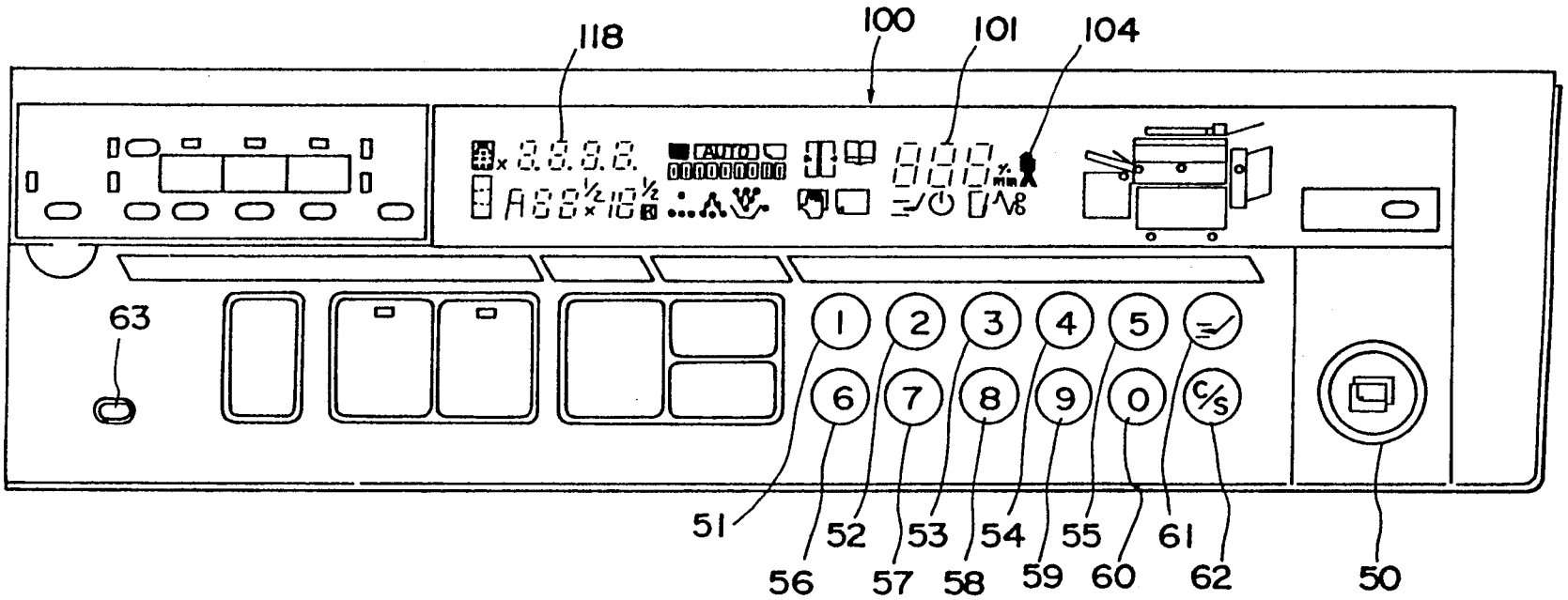
FIG. 2 is a plan view of an operation panel of the copying machine of the invention.

FIG. 2 is a plan view showing the operation panel of the copying machine. The operation panel has a print key 50, ten number entry keys 51 to 60 for entering numbers of copy sheets, interrupt key 61 for an interruption, clear key 62 for cancelling the number of copies entered, display request key 63 and concentrated display arrangement 100. The display request key 63 is a key for displaying the number of remaining copies that can be produced before replacement of the photosensitive member (hereinafter referred to as the "count value" of a maintenance counter), the remaining time to be described later and predicted next maintenance time. The concentrated display arrangement 100 includes a four-digit display 118 for indicating a magnification and clock time, a three-digit display 101 for indicating the number of copy sheets, and a serviceman mark 104 which is serviceman call display for warning the user of necessity for maintenance. The four-digit display 118 and the three-digit display 101 are used as a combined seven-digit display for indicating the count value of the maintenance counter, count value of a total counter for counting the total number of copies, remaining time and predicted next maintenance time. When such data is displayed, the other display of the arrangement 100 is held turned off to interrupt the indication to render the displayed data readily recognizable. The maintenance counter is a subtraction counter. The serviceman mark 104 goes on a predetermined period of time before the count value of the maintenance counter reduces to "0", i.e., when the remaining time becomes shorter than a predetermined period of time to warn the user of the necessity for the replacement of the photosensitive member.

Figure 3:
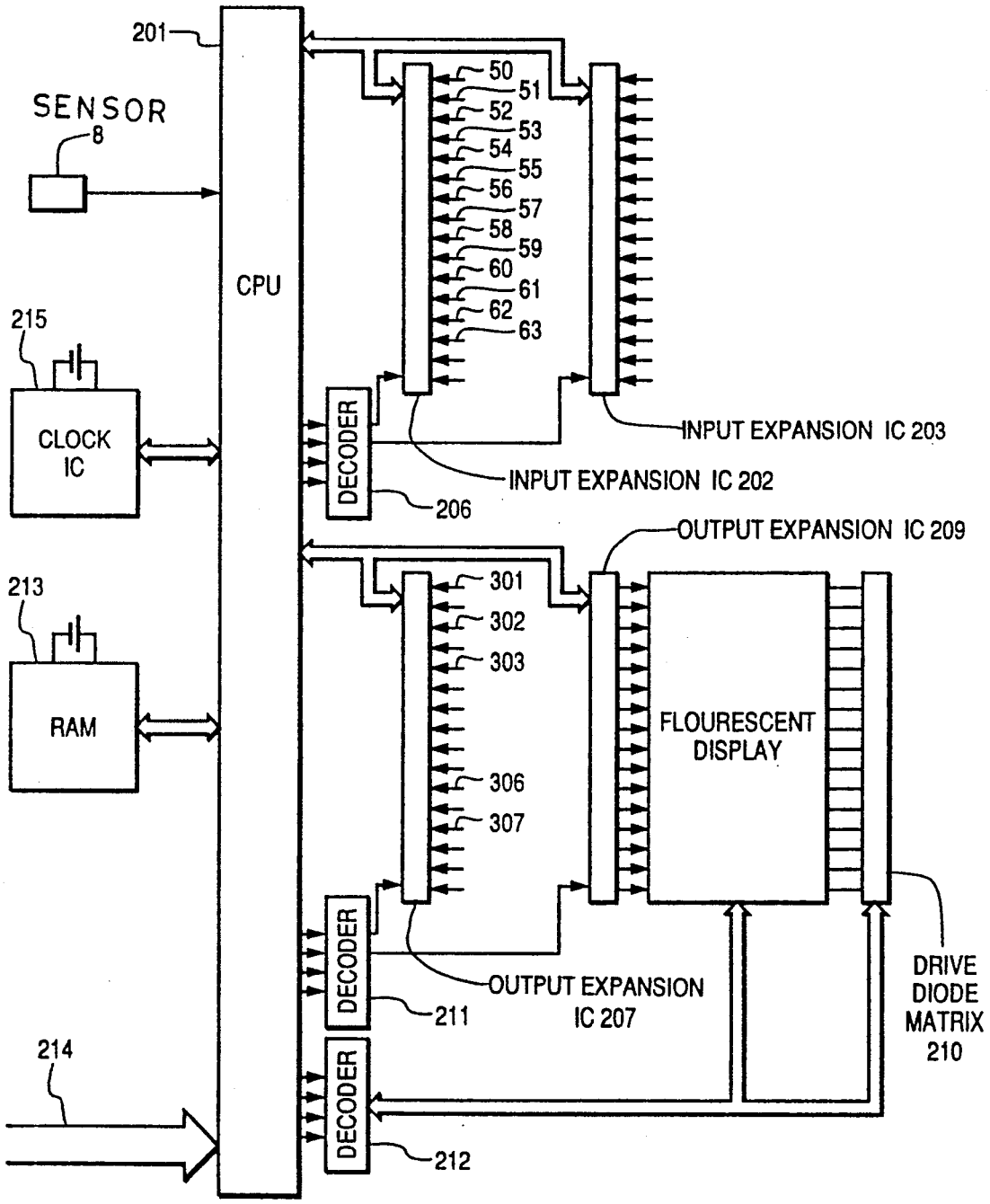
FIG. 3 is an input-output diagram of a CPU for effecting primary control of the copying machine.

FIG. 3 is an input-output diagram of the CPU 201 for effecting the main control of the copying machine. The CPU 201 is connected to the group of keys on the operation panel via a decoder 206 and input expansion ICs 202 and 203. Further through a decoder 211 and an output expansion IC 207, the CPU 201 is connected to drivers such as a main motor 301 for drivingly rotating the photosensitive drum 1, developing motor 302 for the developing unit 4, clutch 303 for a timing roller, sensitizing charger 306 and transfer charger 307. Further through a decoder 212, the CPU 201 is connected to a fluorescent display tube for the display arrangement 100, and a drive diode matrix 210 for display LEDs on the operation panel. Also connected to the CPU 201 are the sensor 8, RAM 213 having a backup power source, clock IC 215 having a backup power source for measuring time and a bus 214 as a communication line with other CPUs.

Figure 4:
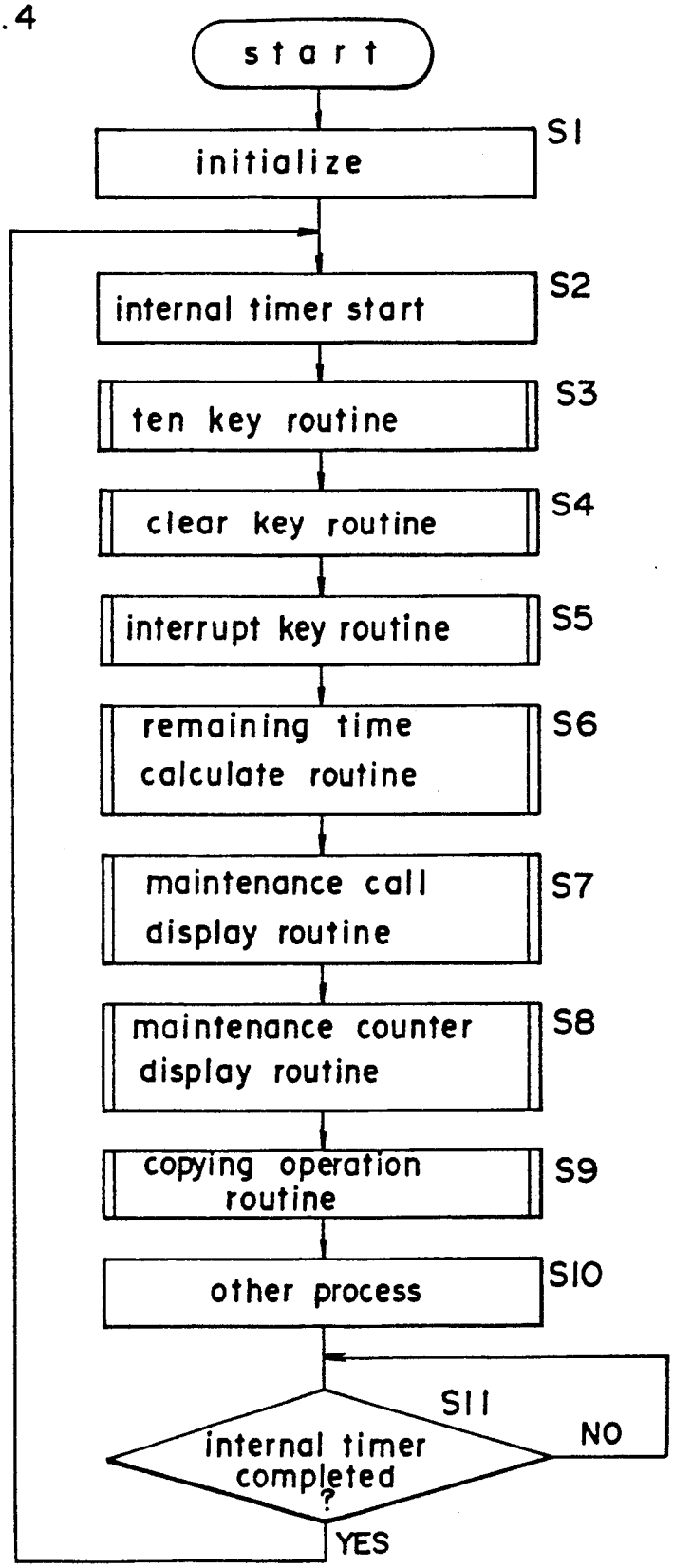
FIG. 4 is a flow chart showing the main routine of the CPU.

The operation of the copying machine will be described next. FIG. 4 is a flow chart showing the main routine of the CPU 201. First with closing of the power source, the memories, registers and flags are initialized (step S1). Next, an internal timer is started which determines the period of the main routine (step S2).

Subsequently executed in succession are a ten key (51–60) routine (step S3), clear key (62) routine (step S4), interrupt key (61) routine (step S5), remaining time calculation routine (step S6), maintenance call display routine (step S7), maintenance counter display routine (step S8) and copying operation routine (step S9) which will be described below.

These steps are followed by other process (step S10) which includes communication with other CPUs. On completion of operation of the internal timer (step S11), the sequence returns to step S2 to repeat the above loop.

Figure 5:
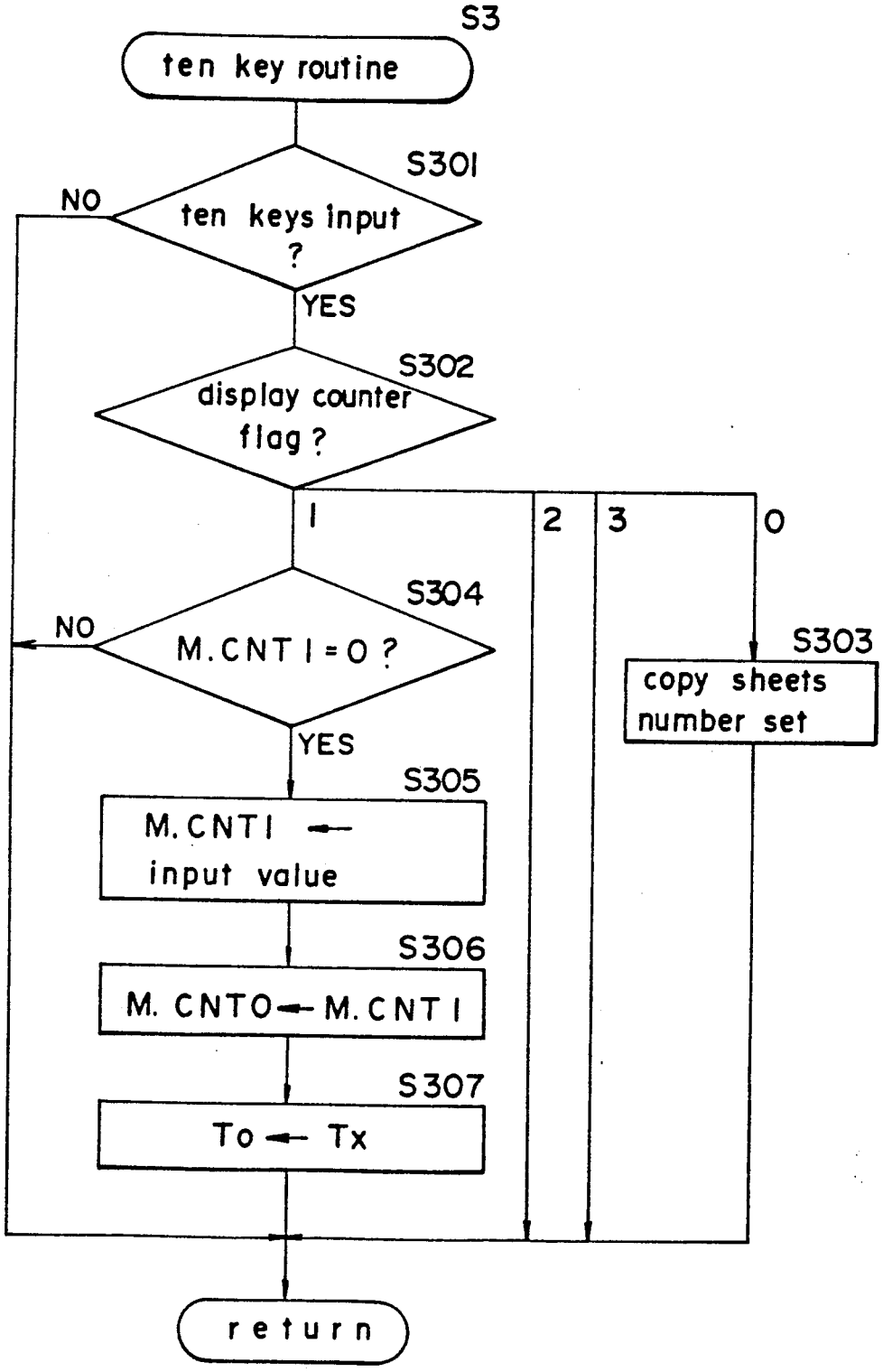
FIG. 5 is a flow chart showing a ten key routine.

FIG. 5 is a flow chart showing the ten key routine (step S3). First, an inquiry is made as to whether an input is given using at least one of ten number entry keys 51 to 60 (step S301). If the answer is in the negative, the sequence returns to the main routine. When the inquiry of step S301 is answered in the affirmative, the count of a display counter, i.e., the value of a display counter flag, is checked (step S302). As will be described later with reference to the maintenance counter display routine, the display counter flag changes to "1" in response to the first input from the display request key 63, to "2" in response to the second input therefrom, to "3" in response to the third input therefrom, and to "0" in response to the fourth input therefrom.

When the display counter flag is found to be "0" in step S302, the input value from the ten keys 51 to 60 is accepted as a copy sheets number setting (step S303).

When the flag is found to be "1" in step S302, the count value M.CNT1 of the maintenance counter is checked as to whether it is "0" (step S304). If the count value M.CNT1 is found to be "0" in step S304 (if the maintenance counter is cleared as will be described later), the input value from the ten keys 51 to 60 is accepted as an initial value M.CNT0 of the maintenance counter (step S305).

The count value M.CNT1 of the maintenance counter entered in step S305 is substituted for the initial count value M.CNT0 (step S306). The current time TX measured in year, month, day, hour and minute (e.g., 18:26, Jun. 10, '92) and indicated by the clock IC215 is stored in the RAM 213 as an initial value T0 for the measured time (step S307).

Figure 6:
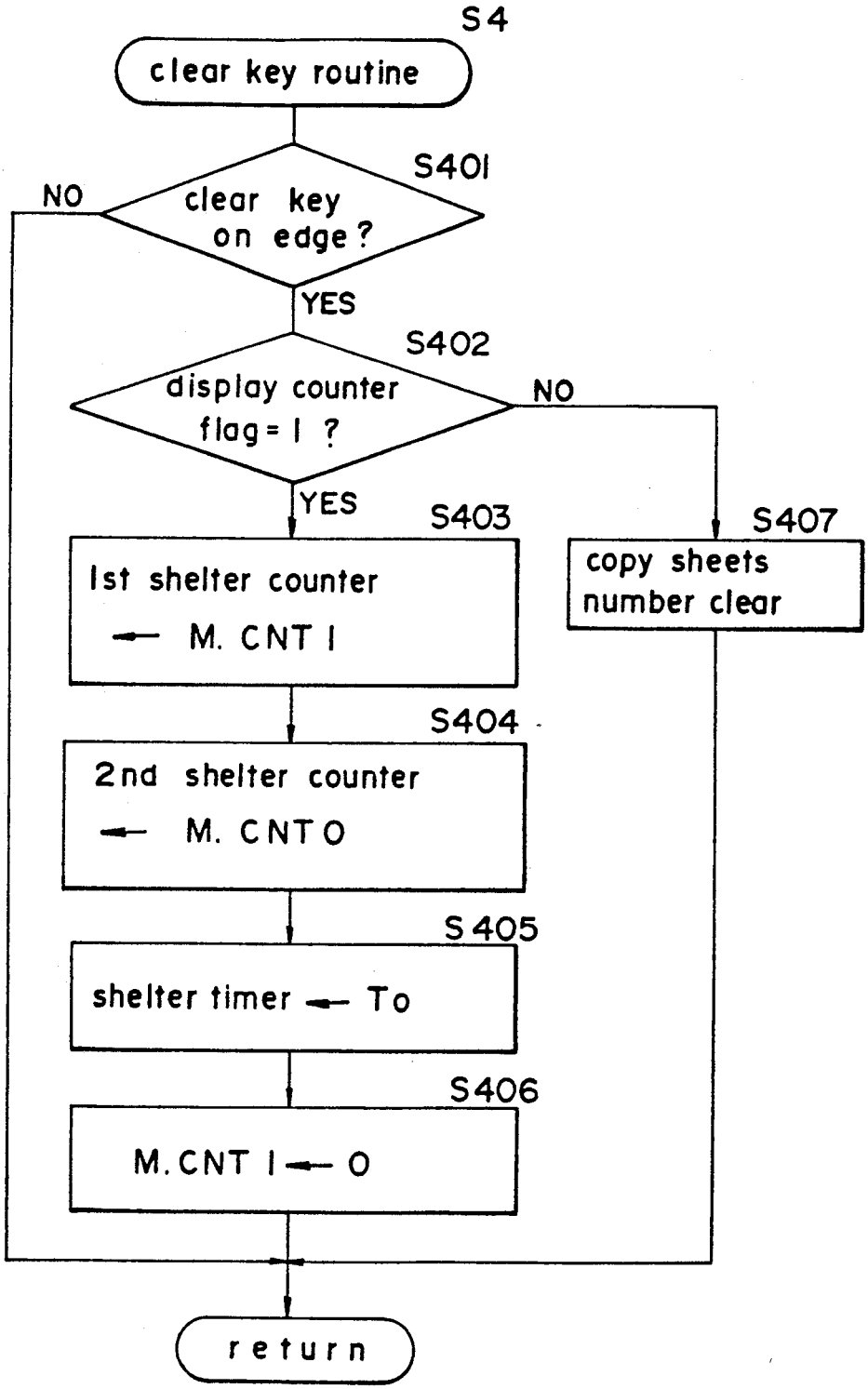
FIG. 6 is a flow chart showing a clear key routine.

FIG. 6 is a flow chart showing the clear key routine (step S4). First, the clear key 62 is checked as to whether it is on edge (step S401). If the clear key 62 is found to be on edge in step S401, an inquiry is made as to whether the display counter flag is "1" (step S402).

In the case where the display counter flag is "1" in step S402, the count value M.CNT1 of the maintenance counter is sheltered in a first shelter counter of the RAM 213 (step S403), the initial count value M.CNT0 is sheltered in a second shelter counter of the RAM 213 (step S404), and the initial measured time value T0 in a shelter timer of the RAM 213 (step S405). These values, i.e., the original count value M.CNT1, initial count value M.CNT0 and initial measured time value T0 are sheltered so as to be restored in the interrupt key routine to be described below, in the case where an erroneous value is keyed in in step S301 of the ten key routine.

Next, the count value M.CNT1 of the maintenance counter is changed to "0" (step S406). Further if the display counter is not found to be "1" in step S402, the copy sheets number setting is cleared (step S407) to display "1".

Figure 7:
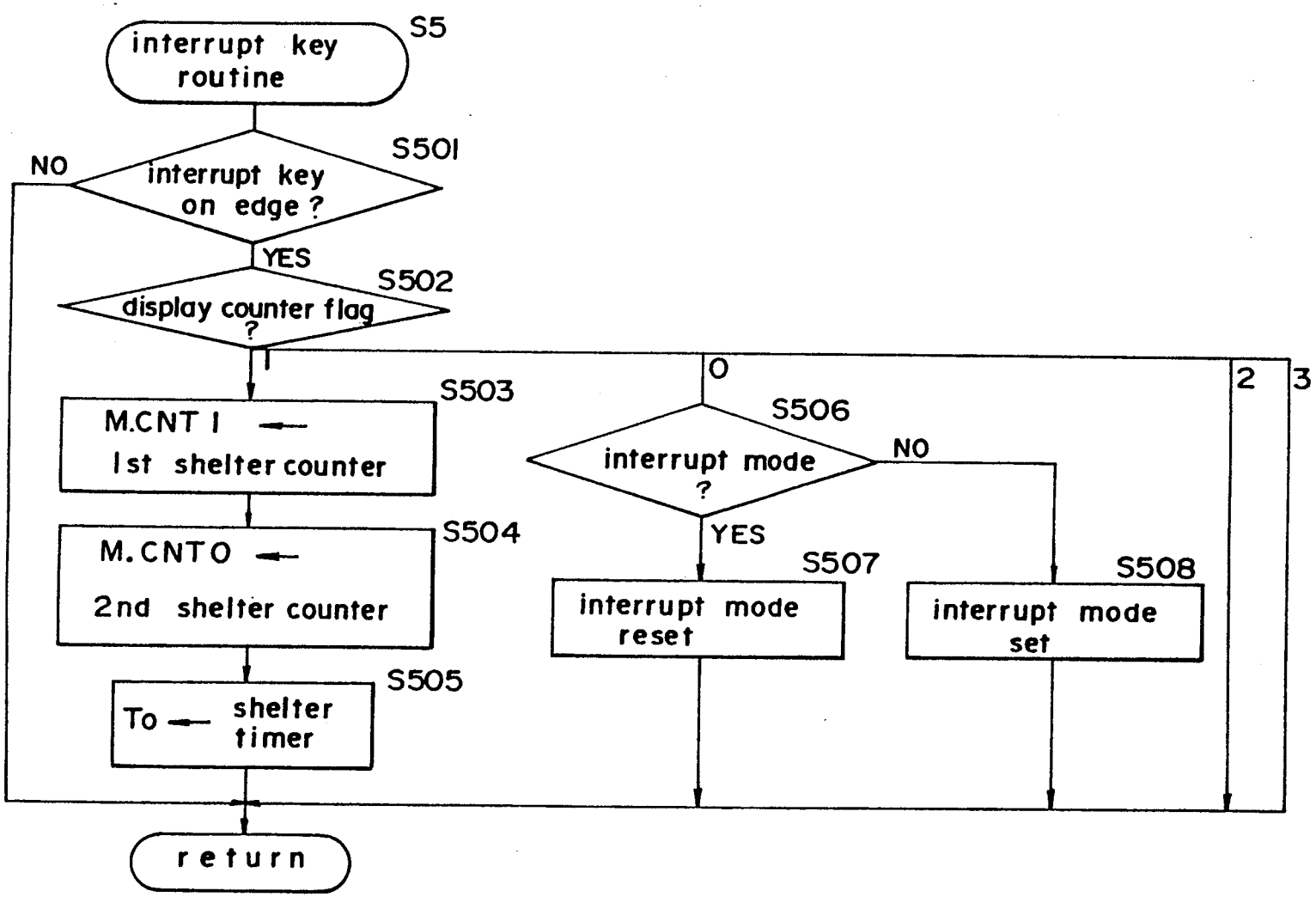
FIG. 7 is a flow chart showing an interrupt key routine.

FIG. 7 is a flow chart showing the interrupt key routine (step S5). First, an inquiry is made as to whether the interrupt key 61 is on edge (step S501). If the answer is affirmative, the value of the display counter flag is checked (step S502).

When the display counter flag is found to be "1" in step S502, the value in the first shelter counter is restored as the count value M.CNT1 of the maintenance counter (step S503), the value in the second shelter counter is restored as the initial count value M.CNT0 (step S504) and the value in the shelter timer is restored as the initial measured time value T0 (step S505).

Alternatively if the display counter flag is found to be "0" in step S502, the current mode is checked as to whether it is an interrupt mode (step S506). When the current mode is the interrupt mode, the interrupt mode is canceled (step S507), whereas if otherwise, the interrupt mode is set (step S508). When the display counter flag is found to be "2" or "3" in step S502, no input is accepted from the interrupt key 61.

Figure 8:
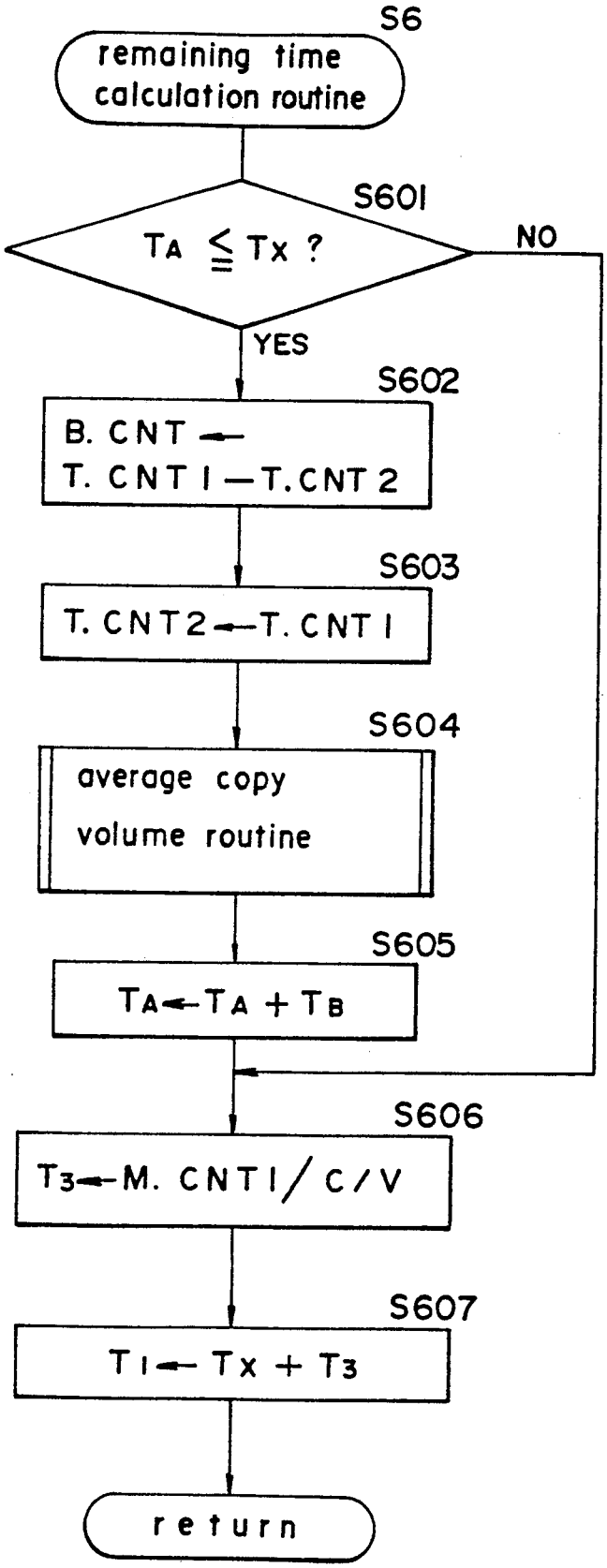
FIG. 8 is a flow chart showing a remaining time calculation routine.

FIG. 8 is a flow chart showing the remaining time calculation routine (step S6). First, the measured time TX of the clock IC 215 is checked as to whether it is at least a set time TA which is renewed every prescribed period of time TB as will be described later (step S601). When the time TX is at least the set time TA, the count value T.CNT2 of the total counter at the previous set time TA is subtracted from the current count value T.CNT1 of the total counter to determine the count value B.CNT counted during the prescribed period of time TB (step S602). Next, the count value T.CNT1 is substituted for the count value T.CNT2 to renew the count value T.CNT2 (step S603). The average copy volume routine is then executed to determine an average copy volume C/V (step S604). With the average copy volume C/V obtained, the prescribed period TB is added to the current set time TA, and the result of addition is substituted for the set time TA to renew the set time TA (step S605). Subsequently, the count value M.CNT1 of the maintenance counter is divided by the average copy volume C/V to calculate remaining time T3 during which copies can be made (step S606). The remaining time T3 is added to the time TX measured at the time of calculation of the remaining time T3 to determine predicted maintenance time T1 (year, month, day, hour, minute, step S607). On the other hand, if the measured time TX has not reached the set time TA in step S601, step S606 follows to calculate the remaining time T3 and predicted maintenance time T1. The prescribed period of time TB is, for example, one month or several weeks.

Figure 9:
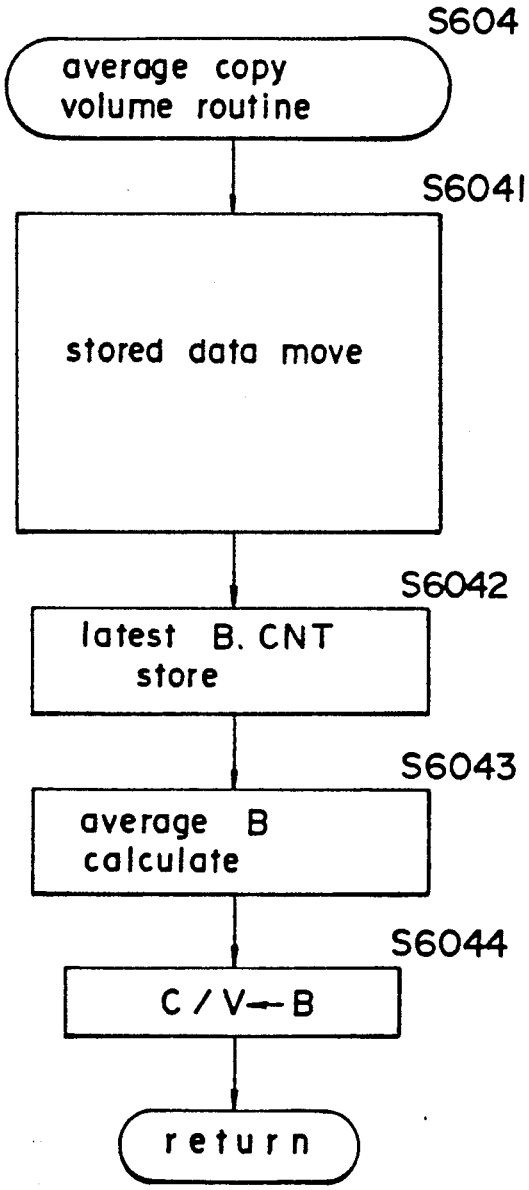
FIG. 9 is a flow chart showing an average copy volume routine.
Figure 10:
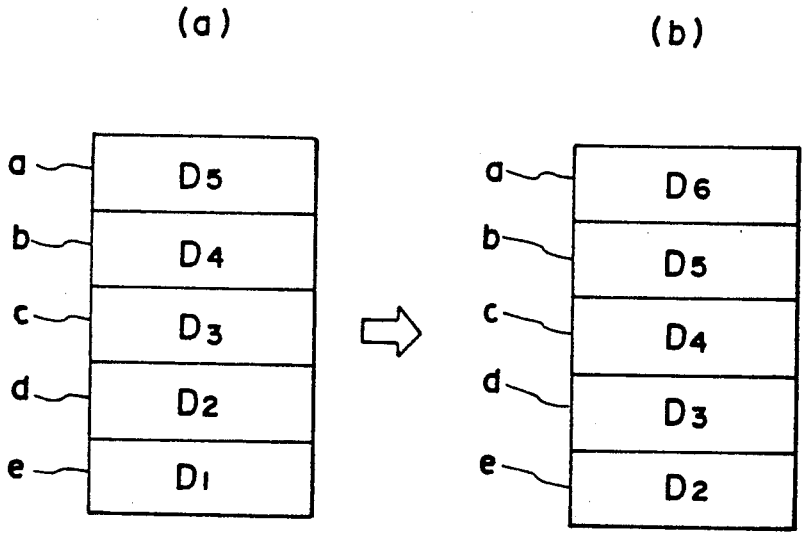
FIG. 10 is a diagram showing the construction of a memory for storing copy volume data.

FIG. 9 is a flow chart showing the average copy volume routine (step S604), and FIGS. 10, (*a*) and (*b*) are diagrams showing the construction of a memory for use in the average copy volume routine. The memory has five addresses, i.e., a first address a to a fifth address e. FIG. 10, (*a*) shows the data arrangement in the memory before the latest data D6 is stored, and FIG. 10, (*b*) shows the data arrangement in the memory after the latest data D6 has been stored. Before the latest data D6 is input, five count values B.CNT, i.e., data items D1 to D5, are stored at the respective addresses as shown in FIG. 10, (*a*). The latest data D6 as to the count value B.CNT is stored in the address a as seen in FIG. 10, (*b*), and the data in the past is shifted by one address toward the fifth address e, with the oldest data D1 erased. More specifically in the average copy volume routine, the data of count value B.CNT at the fourth address d is shifted to the fifth address, and the respective data items of count values B.CNT are thereafter shifted from the third address c to the fourth address d, from the second address b to the third address c, from the first address a to the second address b (step S6041, and the data D6 of the latest count value B.CNT is then stored at the first address a (step S6042). The average B of the count values B.CNT stored at the first address a to the fifth address e is thereafter calculated (step S6043). The result of calculation is substituted for the average copy volume C/V (step S6044).

Figure 11:
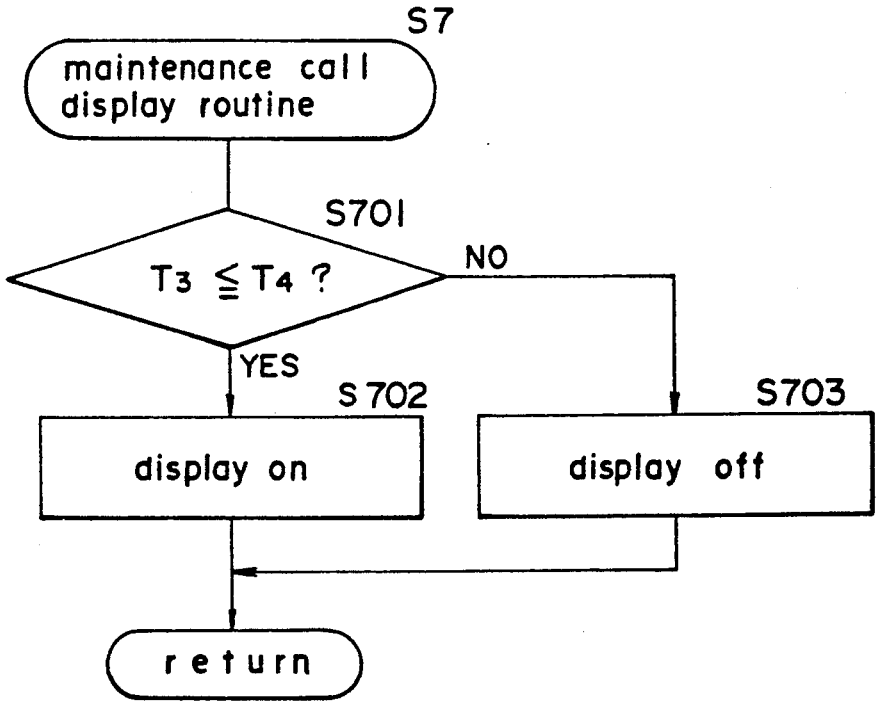
FIG. 11 is a flow chart showing a maintenance call display routine.

FIG. 11 is a flow chart showing the maintenance call display routine (step S7). First, an inquiry is made as to whether the remaining time T3 is up to a predetermined period of time T4 (e.g., 100 hours) (step S701). If the answer to the inquiry of step S701 is affirmative, a maintenance call display, i.e., the serviceman mark 104, is turned on (step S702). On the other hand, if the answer is negative, no maintenance call display is made (step S703).

Figure 12A:
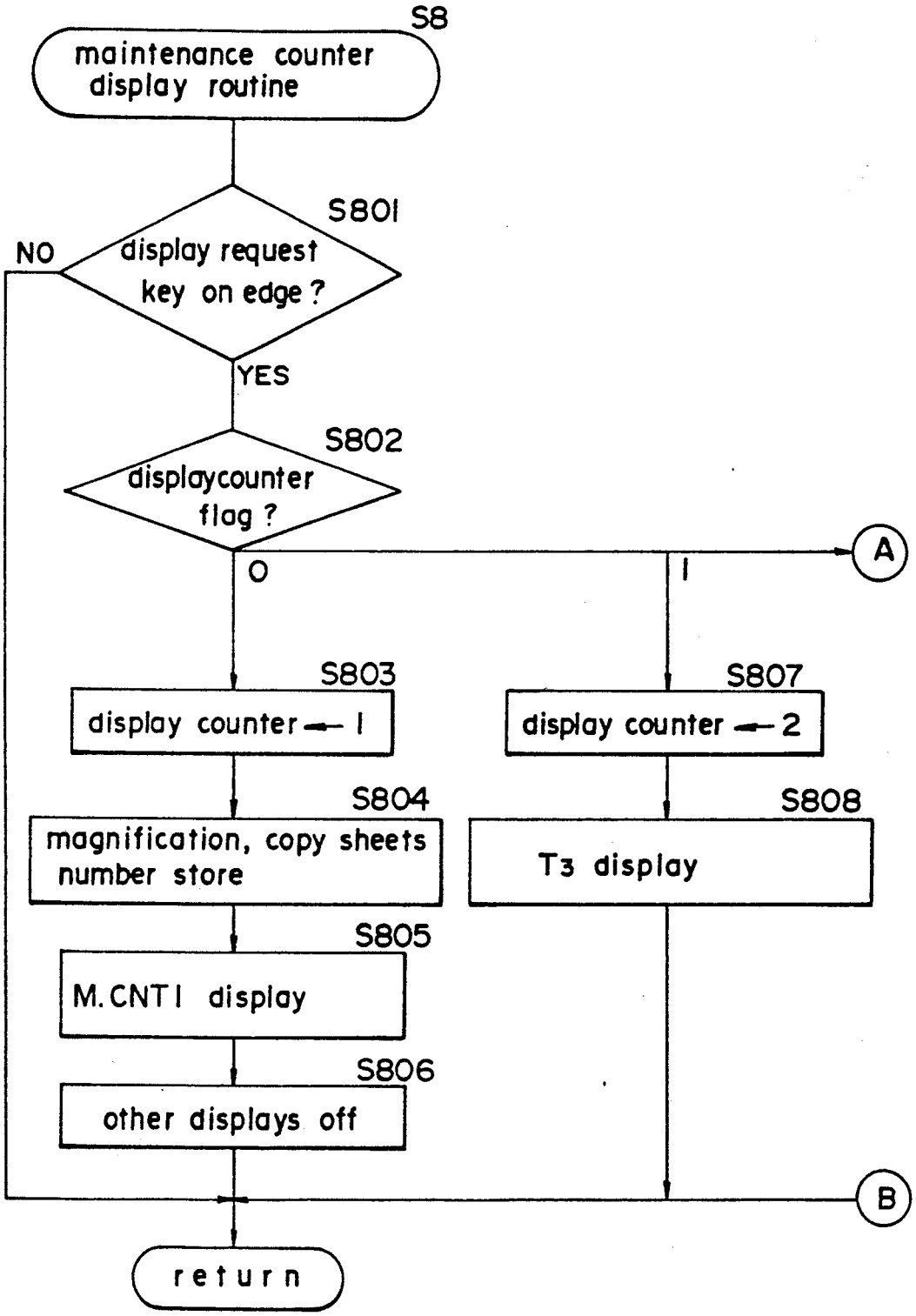
FIGS. 12A and 12B are flow charts showing a maintenance counter display routine.
Figure 12B:
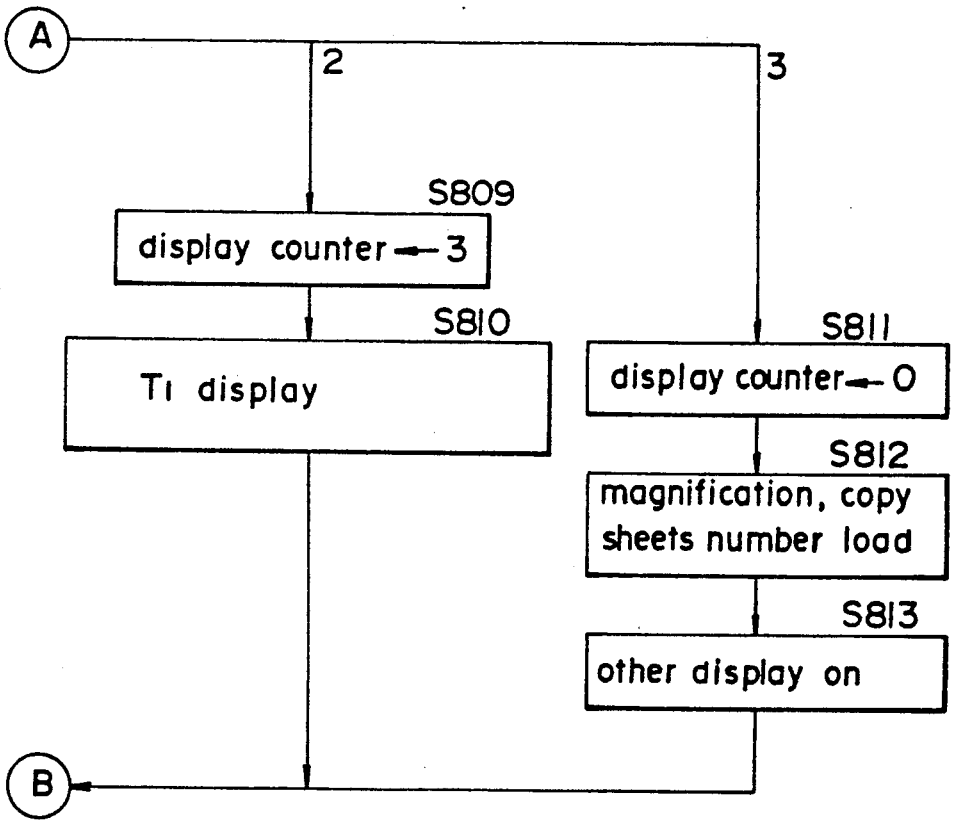

FIGS. 12A and 12B are flow charts showing the maintenance counter display routine (step S8). First as shown in FIG. 12A, an inquiry is made as to whether the display request key 63 is on edge (step S801). If the answer to the inquiry of step S801 is affirmative, the value of the display counter flag is checked (step S802).

When the display counter flag is found "0" in step S802, the flag is set to "1" (step S803), and the magnification and copy sheets number on display before the input of the key 63 is given are sheltered in a stack area of the RAM 213 (step S804). The count value of the maintenance counter is indicated on the combination of magnification display 118 and copy sheets number display 101 (step S805), with the other displays turned off (step S806).

When the display counter flag is found to be "1" in step S802, the flag is set to "2" (step S807), and the remaining time T3 is indicated on the combination of display 118 and display 101 (step S808). When the counter flag is found to be "2" in step S802, the flag is set to "3" (step S809), and the predicted maintenance time T1 is indicated on the combination of display 118 and display 101 (step S810). When the display counter flag is found to be "3" in step S802, the flag is reset to "0" as shown in FIG. 12B (step S811), causing the display 18 and the display 101 to restore the values of magnification and copy sheets, respectively, and turning on the other displays (steps S812 and S813).

Figure 13:
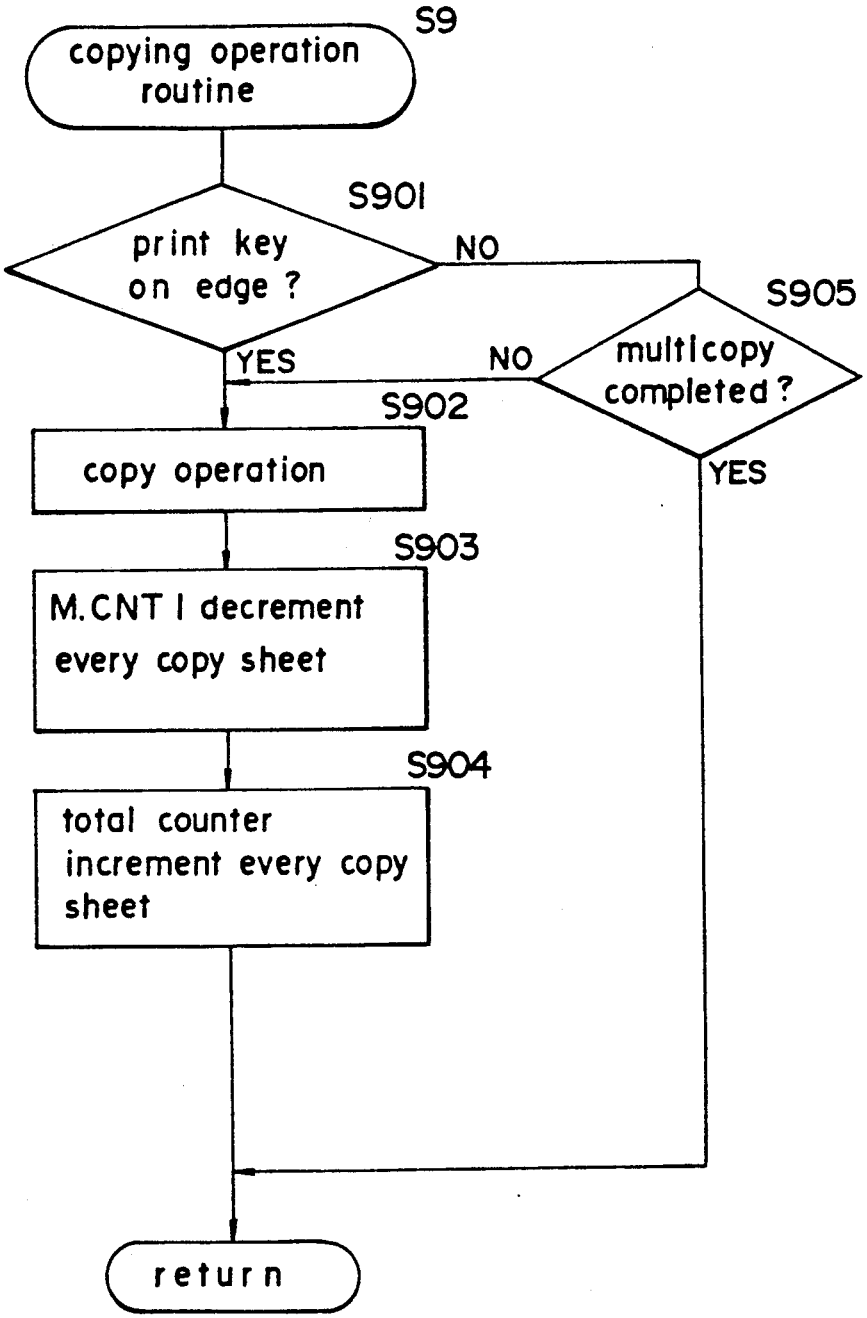
FIG. 13 is a flow chart schematically showing a copying operation routine.

FIG. 13 is a flow chart schematically showing the copying operation routine (step S9). First, an inquiry is made as to whether the print key 50 is on edge (step S901). When the answer is affirmative, a copying operation is started (step S902). Processing for this operation is already known and will not be described in detail.

Next, the count value of the maintenance counter is decremented for every copy sheet (step S903), and the count value of the total counter is correspondingly incremented (step S904). On the other hand, if the answer to the inquiry of step S901 is in the negative, an inquiry is made as to whether multi-copying operation has been completed, and the process described is executed until the completion of this operation. The term "every copy sheet" refers to the completion of each exposure scanning cycle.

Although the average copy volume is determined based on the frequency of image formation during the prescribed period or unit of time TB in the foregoing embodiment, the average copy volume may be calculated based on the time required for forming images a predetermined number of times.

The aforementioned maintenance parts include, besides the photosensitive drum, the light source of the document exposure unit, developing unit, blade of the cleaner, charger, etc. which deteriorate or become consumed with the fequency of use.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a replaceable element for use in connection with formation of images;

first measuring means for measuring an amount of use of the element since a start of use;

first calculation means for calculating a remaining amount of use of the element before a predetermined amount of use of the element is reached for replacement of the element based on a result of measurement by the first measuring means;

counter means for counting a specified period;

second measuring means for measuring an amount of use of the element during the specified period;

second calculation means for calculating an amount of use of the element per unit of time based on a result of measurement by the second measuring means; and means for predicting a time when the predetermined amount of use of the element is to be reached based on results of calculation of the first calculation means and the second calculation means.

2. An image forming apparatus according to claim 1, further includes display means for displaying the time predicted by the predicting means.

3. An image forming apparatus according to claim 2, wherein said predicting means predict remaining time of use of the element before a predetermined amount of use of the element is reached for the replacement of the element and said display means display the remaining time.

4. An image forming apparatus according to claim 3, further includes third calculation means for calculating a predicted next maintenance time based on the remaining time and a current time and said display means display the predicted next maintenance time.

5. An image forming apparatus according to claim 3, further includes warning means for warning when the remaining time becomes shorter than a predetermined period of time.

6. An image forming apparatus according to claim 3, wherein said display means turn on when the remaining time becomes shorter than a predetermined period of time.

7. An image forming apparatus comprising:

a replaceable element for use in connection with formation of images;

first measuring means for measuring a remaining amount of use of the element before a predetermined amount of use of the element is reached for replacement of the element;

second measuring means for measuring an amount of use of the element per unit of time; and means for predicting a remaining time before replacement of the element based on results of the measurement of the first measuring means and the second measuring means.

8. An image forming apparatus according to claim 7, further includes warning means for warning when the remaining time becomes shorter than a predetermined period of time.

9. An image forming apparatus according to claim 7, further includes display means for displaying the remaining time predicted by the predicting means.

10. An image forming apparatus according to claim 9, further includes calculation means for calculating a predicted next maintenance time based on the remaining time and a current time and said display means display the predicted next maintenance time.

* * * * *

UNITED STATES PATENT AND TRADEMARK OFFICE

CERTIFICATE OF CORRECTION

PATENT NO. : 5,216,464

DATED : June 1, 1993

INVENTOR(S) : Akio Kotani, et al.

It is certified that error appears in the above-identified patent and that said Letters Patent is hereby corrected as shown below:

In col. 3, line 37, after "212" insert --and an output expansion IC 209--.

In col. 6, line 26, change "18" to --118--.

Signed and Sealed this

Fifteenth Day of February, 1994

Bruce Lehman

*Attest:*

BRUCE LEHMAN

*Attesting Officer*

*Commissioner of Patents and Trademarks*